US008968859B2

(12) United States Patent
Matsui et al.

(10) Patent No.: US 8,968,859 B2
(45) Date of Patent: Mar. 3, 2015

(54) HEAT EXTENSIBLE FIBER

(75) Inventors: Manabu Matsui, Tochigi (JP); Yoshiji Usui, Hyogo (JP); Shigeki Kawakami, Hyogo (JP)

(73) Assignees: Kao Corporation, Tokyo (JP); Daiwabo Holdings Co., Ltd., Osaka-Shi (JP); Daiwabo Polytec Co., Ltd., Osaka-Shi (JP)

( * ) Notice: Subject to any disclaimer, the term of this patent is extended or adjusted under 35 U.S.C. 154(b) by 1697 days.

(21) Appl. No.: 12/086,131

(22) PCT Filed: Dec. 1, 2006

(86) PCT No.: PCT/JP2006/324112

§ 371 (c)(1),
(2), (4) Date: Sep. 10, 2008

(87) PCT Pub. No.: WO2007/066599

PCT Pub. Date: Jun. 14, 2007

(65) Prior Publication Data

US 2009/0142595 A1 Jun. 4, 2009

(30) Foreign Application Priority Data

Dec. 7, 2005 (JP) ..... 2005-353780
Nov. 15, 2006 (JP) ..... 2006-309513

(51) Int. Cl.
*D04G 3/02* (2006.01)
*D01F 8/06* (2006.01)
*D04H 1/58* (2012.01)
(Continued)

(52) U.S. Cl.
CPC .. *D01F 8/06* (2013.01); *D04H 1/58* (2013.01); *D04H 3/02* (2013.01); *D04H 3/14* (2013.01)
USPC ..... 428/212; 428/370; 442/364; 264/168

(58) Field of Classification Search
USPC ..... 428/370, 212; 442/364; 264/168
See application file for complete search history.

(56) References Cited

U.S. PATENT DOCUMENTS

2006/0063457 A1* 3/2006 Matsui et al. ..... 442/364

FOREIGN PATENT DOCUMENTS

CN 1715477 A 1/2006
JP 43-28262 B 12/1968
(Continued)

OTHER PUBLICATIONS

English translation of Indonesian Office Action issued in Dec. 2009 in corresponding Indonesian Patent Application No. W00 2008 01794.
English translation of JP 2003-119625 A published on Apr. 23, 2003.
English translation of JP 2006-316399 published on Nov. 24, 2006.
(Continued)

*Primary Examiner* — Elizabeth Cole
(74) *Attorney, Agent, or Firm* — Birch, Stewart, Kolasch & Birch, LLP

(57) ABSTRACT

A heat extensible fiber comprises a conjugate fiber including a first resin component having an orientation index of 30% to 70% and a second resin component having a lower melting point or softening point than the melting point of the first resin component and an orientation index of 40% or more, the second resin component being present on at least part of the surface of the conjugate fiber in a lengthwise continuous configuration. The conjugate fiber is a heat-treated or crimped fiber and being configured to thermally extend when heated at a temperature lower than the melting point of the first resin component. The heat extensible fiber has higher heat self-extensibility than conventional extensible fibers.

11 Claims, 3 Drawing Sheets

(51) Int. Cl.
*D04H 3/02* (2006.01)
*D04H 3/14* (2012.01)

(56) References Cited

FOREIGN PATENT DOCUMENTS

| | | | |
|---|---|---|---|
| JP | 2000-96378 | A | 4/2000 |
| JP | 2003-119625 | A | 4/2003 |
| JP | 2006-316399 | A | 11/2006 |
| WO | WO-2004/059050 | A | 7/2004 |
| WO | WO 2004059050 | A1 * | 7/2004 |

OTHER PUBLICATIONS

European Supplemental Search Report issued on Dec. 29, 2009 in corresponding European Patent Application No. 06 83 3882.
Chinese Office Action issued on Mar. 3, 2011 in corresponding Chinese Patent Application No. 200680045825.9 and its English translation.
Chinese Office Action issued on Sep. 30, 2010 in corresponding Chinese Patent Application No. 200680045825.9 with English translation thereof.
Complete English translation of CN 1715477 A.

* cited by examiner

HEAT EXTENSIBLE FIBER

TECHNICAL FIELD

The present invention relates to a heat extensible fiber and nonwoven fabric made therefrom.

BACKGROUND ART

Self-extensible fibers are known. For instance, JP 43-28262B proposes a process of producing a self-extensible polyester fiber tow or staple fiber, comprising passing a tow of shrinkable polyester filaments having a birefringence of at least 0.15 and a crystallinity less than about 35% through a stuffer box crimper and, at the same time, heating the filaments in the crimper with steam or water at 85° C. to 250° C.

JP 2000-96378A proposes a process of producing a self-extensible yarn which is also a polyester fiber, comprising moist-heat treating an undrawn, partially oriented polyester multi-filament yarn with no tension applied at a temperature near which the yarn exhibits the maximum dry heat shrinkage stress.

These self-extensible fibers or yarns are designed for use as multi-filament yarns or filament mixed yarns and are not contemplated for application to nonwoven fabrics, particularly thermal-bonded nonwoven fabric. The self-extensible fibers cannot be used alone to make thermal-bonded nonwoven fabric because they are not per se heat fusible. When they are used to make thermal-bonded nonwoven fabric, they must be combined with heat fusible fibers, which makes the process complicated and is economically disadvantageous. Moreover, in order for the thermal-bonded nonwoven fabric to exhibit physical properties for practical use, the heat fusible fibers should be used in a major proportion, so that the self-extensibility characteristic of the self-extensible fibers cannot be taken full advantage of.

DISCLOSURE OF THE INVENTION

The present invention provides a heat extensible fiber comprising a conjugate fiber including a first resin component having an orientation index of 30% to 70% and a second resin component having a lower melting point or softening point than the melting point of the first resin component and an orientation index of 40% or more. The second resin component is present on at least part of the surface of the conjugate fiber in a lengthwise continuous configuration. The conjugate fiber is a heat treated or crimped fiber and is configured to thermally extend when heated at a temperature lower than the melting point of the first resin component.

The present invention also provides nonwoven fabric containing the heat extensible fibers in its state having extended by heat application.

The present invention also provides a preferred process of producing the heat extensible fiber. The process includes the steps of melt spinning polyethylene and polypropylene having a melt flow rate of 10 to 35 g/10 min and a Q value of 2.5 to 4.0 at a take-up speed less than 2000 m/min to obtain a conjugate fiber and subjecting the conjugate fiber to a heat treatment or a crimping treatment, with the proviso that no drawing is carried out.

DETAILED DESCRIPTION OF THE INVENTION

Figure 1:
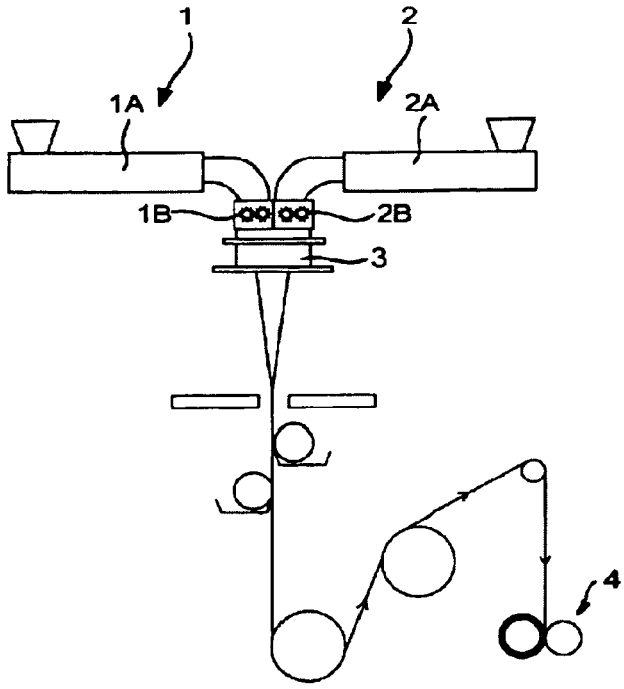
FIG. 1 is a schematic representation of apparatus for a melt spinning process.

The present invention will be described based on its preferred embodiments. The heat extensible fiber of the invention is a bicomponent conjugate fiber comprising a first resin component and a second resin component having a lower melting or softening point than the melting point of the first resin component. The second resin component is present on at least part of the surface of the individual fiber in a lengthwise continuous configuration. Accordingly, the heat extensible fiber of the invention will also be called a heat extensible conjugate fiber. The conjugate fiber of the present invention can take any form, such as a sheath/core configuration, a side-by-side configuration, and so forth.

The first resin component in the heat extensible conjugate fiber serves for heat extensibility, and the second one for heat fusibility. The first resin component has an orientation index of 30% to 70%, preferably 30% to 65%, even more preferably 30% to 60%, most preferably 35% to 55%. The second resin component has an orientation index of 40% or more, preferably 50% or more. It is preferred for the second resin component to have as high an orientation index as possible. There is no particular upper limit. Nevertheless, about 70% would suffice for satisfactory results. The orientation index is an indication of the degree of orientation of the polymer chains of each resin constituting the fiber. When the first and the second resin components have the recited orientation indices, the conjugate fiber extends upon heat application.

The orientation index of the first and the second resin components can be represented by formula (I) shown below, wherein A is a birefringence of the resin in the heat extensible conjugate fiber, and B is an intrinsic birefringence of the resin.

$$\text{Orientation index (\%)} = A/B \times 100 \quad (1)$$

The term "intrinsic birefringence" denotes a birefringence of a resin with its polymer chains perfectly oriented. Intrinsic birefringence values of typical plastic materials are given in, for example, the Japan Society of Polymer Processing (ed.), *Materials for Polymer Processing* (1st ed.), appendix table, Sigma Publishing Co., Ltd., Feb. 10, 1998. For example, the intrinsic birefringence of polypropylene is 0.03, and that of polyethylene is 0.066.

Birefringence of the resins in the heat extensible conjugate fiber is determined with an interference microscope equipped with a polarizer under light polarized in the directions parallel with, and perpendicular to, the fiber axis. The standard refractive index fluid available from Cargille Lab is used as an immersion oil. The refractive index of the immersion oil is measured with an Abbe refractometer. Refractive indices in the directions parallel with and perpendicular to the fiber axis are calculated from the interference fringe patterns obtained with the interference microscope in accordance with the calculation method described in the paper titled "Fiber Structure Formation in High-Speed Melt Spinning of Sheath/Core Type Bicomponent Fibers", Seni Gakkaishi, vol. 51, No. 9, p 408, 1995. A birefringence value is then obtained as a difference between the two refractive indices.

The heat extensible conjugate fiber is configured to extend on heat application at a temperature lower than the melting point of the first resin component. The heat extensible conjugate fiber preferably shows a heat extensibility of 0.5% to 20%, more preferably 3% to 20%, even more preferably 7.5% to 20%, at a temperature 10° C. higher than the melting point or softening point of the second resin component. Heat extensible fibers having such a heat extensibility will provide bulky nonwoven fabric or nonwoven fabric with a three-dimensional appearance, for example, with an appreciably uneven surface texture.

It is preferred that the heat extensibility of the heat extensible conjugate fiber at a temperature 10° C. higher than the melting point of the second resin component is higher than that at the melting point of the second resin component by at least 3 points, more preferably 3.5 points or more. This is to facilitate independently controlling the fusion between the fibers as a result of the melting of the second resin component and the heat extension of the fiber.

The heat extensibility is measured as follows. A thermomechanical analyzer TMA-50 (from Shimadzu Corp.) is used. Fibers aligned in parallel relation are set at a jaw spacing of 10 mm. With a constant load of 0.025 mN/tex applied to the fibers, changes in extensibility with temperature increasing at a rate of 10° C./min are recorded. The extensibility at the melting or softening point of the second resin component and the extensibility at a temperature 10° C. higher than the melting or softening point of the second resin component are read. The reason the heat extensibility measurement is made at the above-specified temperatures is that thermal-bonded nonwoven fabric is produced by fusion bonding the fibers at their intersections usually in the temperature range of from the melting or softening point of the second resin component to about 10° C. higher than the melting or softening point of the second resin component.

The heat extensible conjugate fiber in which the resin components have the respectively recited orientation indices is obtainable by, for example, melt spinning the first and second resin components having different melting points at a take-up speed less than 2000 m/min to form a conjugate fiber and then subjecting the conjugate fiber to a heat treatment or a crimping treatment. Drawing is not carried out.

The melt spinning is performed using a spinning apparatus shown in FIG. 1, which has two extrusion units 1 and 2 and a spinneret 3. The extrusion units 1 and 2 include extruders 1A and 2A and gear pumps 1B and 2B, respectively. Two resin components are separately melted and metered through the respective extruders 1A and 2A and the respective gear pumps 1B and 2B, joined together in the spinneret 3, and ejected through nozzle orifices. The design of the spinneret 3 is selected properly according to the cross-sectional configuration of a conjugate fiber to be produced. Right under the spinneret 3 is placed a winder 4, whereby the molten resin streams ejected from the nozzle orifices are taken up at a prescribed speed. The take-up speed in the melt spinning in the present embodiment is preferably less than 2000 m/min, more preferably 500 to 1800 m/min, even more preferably 1000 to 1800 m/min. The spinneret temperature, namely the spinning temperature varies depending on the resins. In spinning polypropylene as a first resin component and polyethylene as a second resin component, for instance, a recommended spinning temperature is 200° to 300° C., preferably 220° C. to 280° C.

Because of the low spinning speed, the resulting fibers are undrawn fibers. The undrawn fibers are then subjected to a heat treatment and/or a crimp treatment.

The crimp treatment is conveniently carried out by mechanical crimping. Mechanical crimps include a two-dimensional crimp and a three-dimensional crimp. Development of a three-dimensional crimp by an eccentric sheath/core conjugate fiber or a side-by-side conjugate fiber is also a crimp treatment. Any of these crimp treatments is effective in the present invention. Mechanical crimping sometimes involves simultaneous heat application. A heat treatment may follow the crimp treatment. In addition to the heat treatment following the crimp treatment, another heat treatment may precede the crimp treatment. Otherwise, the fibers may be subjected to a heat treatment instead of the crimp treatment.

While the crimp treatment sometimes involves elongation of fibers to some extent, such elongation is not included under "drawing" as referred to in the present invention. The term "drawing" as used herein is intended to denote an operation of about 2- to 6-fold stretching that is commonly conducted on undrawn continuous yarn.

The conditions of the heat treatment are decided appropriately according to the kinds of the first and the second resin components making up the conjugate fiber. The temperature of the heat treatment is lower than the melting point of the second resin component. For instance, a sheath/core conjugate fiber having a high-density polyethylene sheath and a polypropylene core is preferably heated at 50° C. to 120° C., more preferably 70° C. to 115° C., for 10 to 1800 seconds, more preferably 20 to 1200 seconds. Heating is effected by, for example, hot air blowing or irradiation with infrared light. As stated, the heat treatment may follow the crimp treatment.

The heat treatment which is conducted separately from the heat treatment after the crimp treatment or the heat treatment which is performed instead of the crimp treatment is for example a treatment of heating a tow of undrawn fibers (hereinafter referred to as tow heating). When the fibers are to be subjected to a crimp treatment, tow heating is preferably carried out prior to the crimp treatment. Tow heating accelerates crystallization chiefly of the second resin component while causing small or little change in crystallinity of the first resin component. As a result, stiffness is imparted to the fiber without impairing the extensibility. In the case where the crimp treatment is to follow, the tow heating helps the fibers to form crimps with good cardability (processability on a carding machine). The tow heating is preferably performed under a tension such that the fibers are stretched 0.95 to 1.3 times so that the crystallization and orientation of the second resin component may not be relaxed. Tow heating is effected by contact with any of hot water, steam, dry air or a hot roll. Heating with steam is preferred in terms of heat conduction efficiency. The tow heating temperature is preferably 80° C. or higher and lower than the melting point of the second resin component. When the second resin component is polyethylene, the heating temperature is preferably 125° C. or lower, more preferably 100° C. to 105° C., to impart sufficient crimping properties to the fibers and to secure openability of the tow. The tow heating time is preferably as short as possible so as not to induce excessive crystallization and orientation of the first resin component thereby to avoid impairment of heat extensibility. From this viewpoint, the treating time is preferably 0.5 to 10 seconds, more preferably 1 to 5 seconds, even more preferably 1 to 3 seconds.

Configurations of the heat extensible conjugate fiber include sheath/core and side-by-side as previously described. The sheath/core configuration may be concentric or eccentric. A concentric sheath/core configuration is preferred in terms of heat extensibility. In the case where the conjugate fibers are carded into a web which is then consolidated into nonwoven fabric, an eccentric sheath/core configuration is preferred in terms of cardability. In order for the heat extensible conjugate fiber with a sheath/core configuration, either concentric or eccentric, to achieve a high heat extensibility, it is preferred that the core is made of the first resin component, and the sheath be made of the second one.

In the case of the sheath/core conjugate fiber, it is preferred that the second resin component is disposed around the first resin component and form at least 20% of the conjugate fiber surface so that the second resin component may melt on the fiber surface when thermally bonded. In the case of an eccentric sheath/core conjugate fiber, the center of gravity of the first resin component is biased from the center of gravity of the conjugate fiber. The degree of bias (hereinafter also referred to as eccentricity) is represented by the ratio of the distance between the center of gravity of the first resin component and that of the conjugate fiber to the radius of the conjugate fiber, as measured on an enlarged cross-section of the conjugate fiber taken with, e.g., an electron microscope.

Another type of a conjugate configuration in which the center of gravity of the first resin component is biased from the center of gravity of the conjugate fiber is a side-by-side configuration. Some of multi-core type conjugate fibers have a group of cores biased from the center of gravity of the fiber. Eccentric sheath/core conjugate fibers are particularly preferable because those are advantageous for easily developing a desired wavy and/or helical crimp. The eccentricity of the eccentric sheath/core conjugate fiber is preferably 5% to 50%, more preferably 7% to 30%. The cross-sectional shapes of the first resin component include not only circle but modified cross-sections such as ellipse, "Y" shape, "X" shape, "#" shape (the shape of a number sign), polygon, and star. The cross-sectional shapes of the conjugate fiber include not only circle but modified cross-sections such as ellipse, "Y" shape, "X" shape, "#" shape (the shape of a number sign), polygon, and star, and a hollow shape.

Preferred configurations of a crimp other than a mechanical crimp of the heat extensible conjugate fiber are illustrated in FIGS. 5(*a*) through 5(*d*). FIG. 5(*a*) shows a wavy crimp with a curved crest; FIG. 5(*b*) a helical crimp with a helically curved crest; FIG. 5(*c*) a combination of a wavy crimp and a helical crimp; and FIG. 5(*d*) a combination of an acute-angled crimp resulting from mechanical crimping and a wavy crimp. These crimp configurations are developed as a result of, for example, the cross-sectional configuration of the conjugate fiber in which the center of gravity of the first resin component is biased from the center of gravity of the conjugate fiber. The fibers having these crimp configurations are preferred in terms of cardability when carded into a web, which is consolidated into nonwoven fabric, or bulkiness of nonwoven fabric made therefrom.

The first and the second resin components are not particularly limited in kind, and any resins having fiber forming properties are useful. It is particularly desirable, for ease of manufacturing nonwoven fabric through heat fusion, that the difference between the two resin components in melting point or the difference between the melting point of the first resin component and the softening point of the second resin component is at least 20° C., more desirably 25° C. or greater. In the case of a sheath/core conjugate fiber, the resin components are combined so that the melting point of the core may be higher than the melting point or softening point of the sheath. It is preferred for the first resin component to have crystallinity. A resin having crystallinity is a resin that develops sufficient orientation and crystals when melt spun followed by drawing at a commonly practiced draw ratio. It is a resin having a definite melting point as a peak temperature as measured by the method hereinafter described. To give examples of preferred combinations of the first and the second resin components, polypropylene (PP) as a first resin component can be combined with polyethylene resins such as high-density polyethylene (HDPE), low-density polyethylene (LDPE), and linear low-density polyethylene (LLDPE), an ethylene-propylene copolymer, polystyrene, etc. In using, as a first resin component, a polyester resin such as polyethylene terephthalate (PET) or polybutylene terephthalate (PBT), examples of the second resin component to be combined include those recited above as examples of the second resin component and, in addition, polypropylene (PP) and co-polyesters. Useful first resin components further include polyamide resins and copolymers of two or more monomer units making up the above-enumerated first resin components. Useful second resin components further include copolymers of two or more monomer units making up the above-recited second resin components. These resins can be combined appropriately.

The above-described resin components may contain other resin components in addition to the first and the second resin components as long as the performance required is not impaired. Examples of the other resins that can be used in addition include olefin polymers and copolymers such as polyethylene, polypropylene, polymethyl pentene, ethylene-propylene copolymers, ethylene-vinyl alcohol copolymers, and ethylene-vinyl acetate copolymers; (co)polyesters such as polyethylene terephthalate, polybutylene terephthalate, and polytrimethylene terephthalate; and (co)polyamides such as polyamide 6, polyamide 66, and polyamide 12. The proportion of the other resin components in the total resin components is preferably 30% by mass or less per 100 parts by mass based on the total mass of the resin components. The resin components may further contain additives other than the resin components, such as inorganic substance, a nucleating agent, and a pigment. Examples of a useful inorganic substance, nucleating agent, and pigment include titanium oxide, zinc oxide, silica, carboxylic acid metal salts, e.g., sodium benzoate and sodium t-butylbenzoate, benzylidene sorbitols, phosphoric acid metal salts, γ-quinacridone, quinacridone quinone, pimelic acid/stearic acid mixture, and N,N'-dicyclohexyl-2,6-naphthalanedicarboxyamide. The amount of these additives to be added is preferably not more than 10 parts by mass per 100 parts by mass of the total resin components.

Of various conceivable combinations of the first and the second resin components, a combination of polypropylene as a first resin component and polyethylene, particularly high density polyethylene as a second resin component is especially preferred; for one thing, their difference in melting point is in the range of from 20° C. to 40° C., which is advantageous for ease of manufacturing nonwoven fabric; for another, the resulting conjugate fiber has a low specific gravity, which is advantageous for providing light-weight, economical nonwoven fabric that can be disposed of by incineration with a small amount of heat. Furthermore, the heat extensible conjugate fiber made from this combination exhibits high heat extensibility for the following reasons. The heat extensible conjugate fiber has a structure in which the orientation index of the first resin component is confined within a specific range while the second resin component has an increased orientation index. Polyethylene, particularly high density polyethylene as a second resin component is a substance having high crystallinity. Therefore, heat extension of the heat extensible conjugate fiber is restrained by polyethylene until the heating temperature reaches the melting point of polyethylene. Upon the temperature reaching and exceeding the melting point of polyethylene, polyethylene starts melting, and polypropylene as the first resin component, being freed from the restraint, is allowed to extend itself and the fiber as a whole.

The polypropylene/polyethylene combination is preferably combination (1) below, more preferably combination (2) below. These combinations are advantageous in that polyethylene as the second resin component is easily oriented in melt spinning to have increased crystallinity, and polypropylene as the first resin component is oriented to an appropriate degree, so that the resulting fiber exhibits ensured heat extensibility.

(1) A combination of polypropylene having a melt flow rate (MFR) of 10 to 35 g/10 min and a Q value of 2.5 to 4.0 and polyethylene having an MFR of 8 to 30 g/10 min and a Q value of 4.0 to 7.0.

(2) A combination of polypropylene having an MFR of 12 to 30 g/10 min and a Q value of 3.0 to 3.5 and polyethylene having an MFR of 10 to 25 g/10 min and a Q value of 4.5 to 6.0.

It is preferred to use, as the first resin component, polypropylene (PP) having a melt flow rate (MFR) of 10 to 35 g/10 min and a Q value of 2.5 to 4.0, more preferably an MFR of 12 to 30 g/10 min and a Q value of 3.0 to 3.5. It is assumed that PP satisfying these conditions is slower in crystallizing than polyethylene having fiber-forming properties so that a large amount of the PP remains amorphous, which contributes to easy extension on heat application to the fiber. PP having the recited MFR has an appropriate melt tension when spun, so that fiber breaks hardly occur during melt spinning. The resulting fiber has moderate orientation and crystallinity, good heat extensibility as well as good stiffness. The resulting fiber is easy to crimp, has improved cardability, and provides nonwoven fabric with good uniformity. PP satisfying the recited Q value condition is slower in crystallizing than the polyethylene component so that a large amount of the PP remains amorphous, which seems to contribute to easy extension on heat application to the fiber.

It is preferred to use, as the second resin component, polyethylene (PE) having an MFR of 8 to 30 g/10 min and a Q value of 4.0 to 7.0, more preferably an MFR of 10 to 25 g/10 min and a Q value of 4.5 to 6.0. PE satisfying the recited MFR condition has an appropriate melt tension and melt viscosity so that fiber breaks hardly occur during melt spinning. The PE imparts stiffness to the fiber without interfering with the heat extending behavior of PP. PE having a Q value of 4.0 to 7.0 produces a large amount of crystalline portion as compared with the PP component, which imparts stiffness, crimp retention, and improved cardability to the resulting fiber.

The Q value is a ratio of weight average molecular weight (Mw) to number average molecular weight (Mn), which is obtained by gel permeation chromatography (GPC).

The MFR of polypropylene is measured in accordance with JIS K7210 at 230° C. and 2.16 kg load. Similarly, the MFR of polyethylene is measured in accordance with JIS K7210 at 190° C. and 2.16 kg load.

The melting points of the first and the second resin components are measured by thermoanalysis using a differential scanning thermal analyzer DSC-50 (from Shimadzu Corp.). Finely cut pieces of a fiber sample (sample mass 2 mg) are analyzed at a rate of temperature rise of 10° C./min to measure the melting peak temperature for each resin, which is taken as the melting point of the resin. When the melting point of the second resin component is not clearly measurable by this method, the temperature at which the second resin component fuses to itself to form a fusion bond having a measurable bond strength is taken as a softening point at which the resin molecules begin to fluidize.

A weight ratio of the first to the second resin components in the heat extensible conjugate fiber of the present invention is preferably 10:90 to 90:10(%), more preferably 50:50 to 80:20 (%), even more preferably 55:45 to 75:25(%). As long as the ratio falls within that range, the fiber exhibits sufficient mechanical characteristics for practical use, and the proportion of the fusible component is adequate for sufficient fusion between fibers. It is preferred that the first resin component as a core is present in a greater proportion than the second resin component to improve cardability of the fibers when carded in the production of nonwoven fabric without impairing extensibility of the fibers.

The thickness of the heat extensible conjugate fiber is selected appropriately according to the intended use of the conjugate fiber. Usually, the thickness is 1.0 to 10 dtex, preferably 1.7 to 8.0 dtex, from the viewpoint of spinnability, spinning cost, cardability, productivity, production cost, and the like.

The heat extensible conjugate fiber of the invention has per se heat fusibility; therefore, it provides easily thermal-bonded nonwoven fabric, i.e., nonwoven fabric in which fibers have been bonded (fused) to each other by heat application. The heat extensible conjugate fibers in the thermal-bonded nonwoven fabric have extended by the heat application for making the nonwoven fabric.

Figure 2:
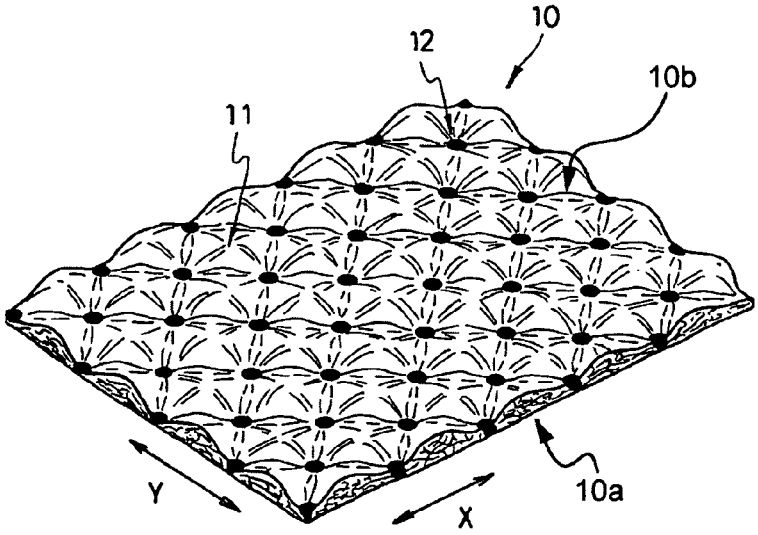
FIG. 2 is a perspective of an embodiment of nonwoven fabric containing the heat extensible fibers of the invention.

FIG. 2 illustrates a perspective of an embodiment of a nonwoven fabric made from the heat extensible fibers of the present invention. The nonwoven fabric 10 of the present embodiment has a single ply structure. The nonwoven fabric 10 is substantially flat on its one side 10*a* and uneven, with a number of protrusions 11 and depressions 12, on the other side 10*b*. The depressions 12 include bonded parts formed by press-bonding or adhesively bonding the constituent fibers of the nonwoven fabric 10. The protrusions 11 are located between the depressions 12 and filled with the constituent fibers of the nonwoven fabric 10. The bonded parts are bonds where the fibers constituting the nonwoven fabric 10 are press-bonded or adhesively bonded to each other. The means for press-bonding the fibers is exemplified by embossing with or without heat and ultrasonic embossing. The means for adhesively bonding the fibers is exemplified by application of an adhesive of various kinds.

The protrusions 11 and the depressions 12 alternate in one direction (direction X in FIG. 2) and also in a direction perpendicular to the one direction (direction Y in FIG. 2) of the nonwoven fabric. When used as a topsheet of disposable hygienic articles such as disposable diapers or sanitary napkins, the nonwoven fabric 10 having the protrusions 11 and the depressions 12 so arranged effectively prevents skin overhydration or rash because of its reduced contact area with the wearer's skin.

The fibers in the parts other than the bonded parts, mostly in the protrusions 11, in the nonwoven fabric 10 are bonded to each other at their intersections by means other than the press-bonding or adhesively bonding means described above.

A preferred process of producing the nonwoven fabric 10 having the above structure will be described by way of FIG. 3. A web 20 formed solely or partly of the heat extensible conjugate fibers is prepared using a prescribed web forming apparatus not shown. Known web forming methods such as (a) carding method in which staple fibers are opened on a carding machine and (b) laying method (air-laid method) in which staple fibers are laid on a net by air can be used.

The web 20 is forwarded into a heat embossing unit 21 where it is thermally embossed. The heat embossing unit 21 has a set of rolls 22 and 23. The roll 22 is a smooth roll with a smooth peripheral surface, and the roll 23 is an engraved roll having a number of projections on its peripheral surface. Both the rolls 22 and 23 are configured to be heated to a predetermined temperature.

The heat embossing is carried out at or above the melting point of the lower melting component and below the melting point of the higher melting component of the heat extensible conjugate fiber in the web 20, whereby the heat extensible conjugate fibers in the web 20 are press-bonded or adhesively bonded to form a number of bonded parts. There is thus obtained a thermal bonded nonwoven fabric 24. The individual bonded parts are circles, triangles, rectangles, other polygons, or a combination thereof, each having an area of about 0.1 to 3.0 $mm^2$. The bonded parts are formed in a regular pattern over the entire area of the thermal bonded nonwoven fabric 24. The bonded part may be a continuous straight or curved line with a line width of about 0.1 to 3.0 mm. The design of the bonded parts is chosen as appropriate to the end use. It should be noted, however, that a certain proportion of the heat extensible conjugate fibers should remain non-bonded so as to develop a three-dimensional relief pattern. Accordingly, the embossed area ratio is preferably 1% to 25%, more preferably 2% to 15%, in view of forming a three-dimensional uneven pattern effectively on the nonwoven fabric 24.

Figure 4A:
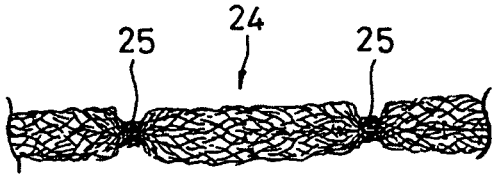
FIG. 4(*a*) and FIG. 4(*b*) each illustrate a state of a web in a step of the production of the nonwoven fabric shown in FIG. 2.
Figure 4B:
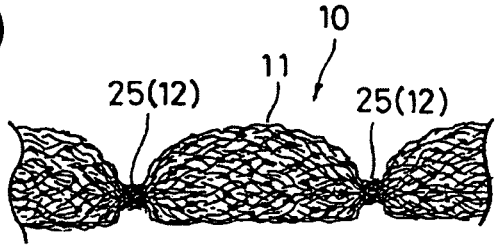
Figure 5A:
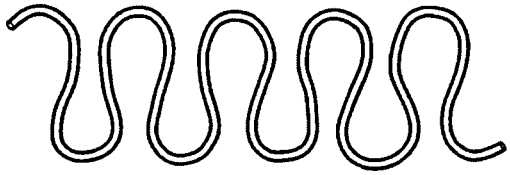
FIG. 5(*a*), FIG. 5(*b*), FIG. 5(*c*), and FIG. 5(*d*) each illustrate an example of the crimp of a fiber.
Figure 5B:
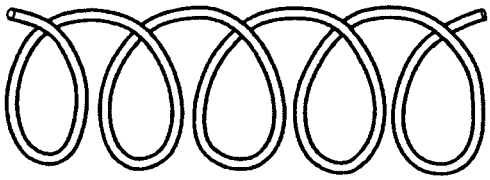
Figure 5C:
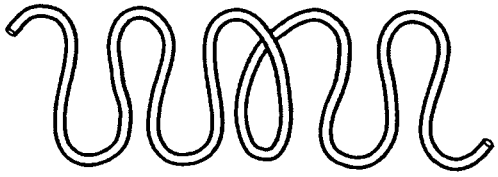
Figure 5D:
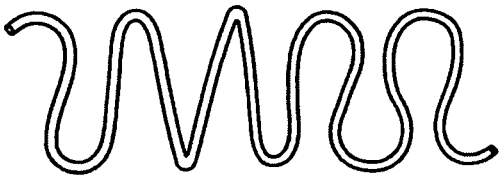

FIG. 4(*a*) schematically illustrates a cross-sectional view of the thermal-bonded nonwoven fabric 24. The nonwoven fabric 24 has a number of bonded parts 25 as a result of the heat embossing. In the bonded parts 25, the heat extensible conjugate fibers have been press-bonded or fusion-bonded by melting and solidification. In the parts other than the bonded parts 25, on the other hand, the heat extensible conjugate fibers are in a free state, not being fixed by press-bonding or fusion-bonding.

Referring back to FIG. 3, the thermal bonded nonwoven fabric 24 is transported to a hot air blowing unit 26, where the thermal bonded nonwoven fabric 24 is subjected to through-air bonding. The hot air blowing unit 26 is configured to cause hot air at a prescribed temperature to pass through the thermal bonded nonwoven fabric 24.

The through-air bonding is carried out at a temperature at which the heat extensible conjugate fibers in the thermal bonded nonwoven fabric 24 thermally extend and at which the heat extensible conjugate fibers present in a free state in the parts other than the bonded parts 25 of the nonwoven fabric 24 fuse and adhere to each other at their intersections. The through-air bonding temperature should be lower than the melting point of the higher melting component of the heat extensible conjugate fibers.

The heat extensible conjugate fibers present in the parts other than the bonded parts 25 extend by the heat of the through-air bonding process. Since a part of the heat extensible conjugate fiber is immobilized at the bonded parts 25, the part of the fiber that is allowed to extend is only between the bonded parts 25. With a part of the heat extensible conjugate fiber immobilized at the bonded part 25, the extending fiber cannot move but in the thickness direction, being prevented from moving in the planar direction, of the nonwoven fabric 24. As a result, the protrusions 11 are formed between the bonded parts 25 to provide the nonwoven fabric 10 that is bulky and have a three-dimensional appearance due to the numerous protrusions 11. The through-air bonding process also causes the heat fusible conjugate fibers present between the bonded parts 25 to fusion bond to each other at their intersections. This state is represented by FIG. 4(*b*). As is understandable from FIG. 4(*b*), the term "three-dimensional appearance" means uneven surface texture of the nonwoven fabric 10.

As is apparent from the foregoing, the nonwoven fabric 10 has the heat extensible conjugate fibers press-bonded or adhesively bonded in the bonded parts 25 and thermobonded at their intersections by through-air bonding, that is a means for bonding other than press-bonding and adhesively bonding, in the parts other than the bonded parts 25, mostly in the protrusions 11. As a result, the nonwoven fabric 10 has a three-dimensional relief pattern and is soft and yet hardly fuzzes owing to the bond strength between the fibers in the protrusions 11. The above described method of producing the nonwoven fabric 10 is a mere combination of thermal bonding and through-air bonding, both of which are very common in the manufacture of nonwovens, and includes no special step. Therefore, the production steps involved are simple and convenient to carry out and achieve high production efficiency. The above described method is capable of easily producing a nonwoven fabric 10 which is light-weight and yet has a three-dimensional relief pattern. Unlike conventional nonwovens with a relief pattern, the nonwoven fabric with a relief pattern can be manufactured even when it is a single-layered structure.

In order to develop a more clearly defined relief pattern of the nonwoven fabric 10, the through-air bonding process is preferably effected by blowing hot air from the side that has faced the smooth roll in the heat embossing process.

As previously described, the nonwoven fabric 10 contains, or is made solely of, the heat extensible conjugate fibers. In the case where the nonwoven fabric 10 contains the heat extensible conjugate fibers, examples of the other fibers that can be used in the nonwoven fabric 10 include thermoplastic resin fibers having a melting point higher than the heat extending temperature of the heat extensible conjugate fiber and fibers that are essentially non-heat-fusible, such as natural fibers, e.g., cotton and pulp, rayon, and cellulose acetate fibers. The proportion of the other fibers in the nonwoven fabric 10 is preferably 5% to 50% by weight, more preferably 20% to 30% by weight. The proportion of the heat fusible conjugate fibers in the nonwoven fabric 10 is preferably 50% to 95% by weight, more preferably 70% to 95% by weight, to form a three-dimensional relief pattern effectively. It is particularly preferred that the nonwoven fabric 10 is made solely of the heat extensible conjugate fibers to form a relieve pattern more effectively.

The nonwoven fabric 10 thus obtained is applicable to various fields with its relief pattern, high bulkiness and strength being taken into advantage. For example, it is suitable for use as a topsheet, a second sheet (a sheet interposed between a topsheet and an absorbent member), a backsheet or a leakproof sheet of disposable hygiene articles such as disposable diapers and sanitary napkins, a body cleaning sheet, a skin care sheet, a wipe for inanimate objects, and the like.

The nonwoven fabric for use in the applications described above preferably has a basis weight of 15 to 60 $g/m^2$, more preferably 20 to 40 $g/m^2$. The thickness of the nonwoven fabric is preferably 1 to 5 mm, more preferably 2 to 4 mm, while a suitable thickness varies depending on the use and is adjusted as appropriate for the use.

The present invention has been described based on its preferred embodiments, but the invention is not limited thereto. For example, while in the foregoing embodiments the bonded parts 25 are formed by embossing with heat application, i.e., heat embossing, heat embossing may be replaced with embossing with no heat application or ultrasonic embossing. The bonded parts may also be formed by applying an adhesive. The layer structure of the nonwoven fabric 10 is not limited to single-ply. The nonwoven fabric 10 may have a dual- or multi-ply structure.

EXAMPLES

The present invention will now be illustrated in greater detail with reference to Examples, but the present invention should not be construed as being limited thereto.

Examples 1 to 10 and Comparative Examples 1 to 4

Concentric or eccentric sheath/core conjugate fibers (an undrawn tow) were made by melt spinning under the conditions shown in Table 1 below. A textile processing agent was applied to the undrawn tow, and, if necessary, the tow was heat treated in steam at about 100° C. for about 3 seconds under tension such that the tow might be stretched 1.0 time to eliminate slack. The tow was subjected to two-dimensional mechanical crimping process and then heat treated (dried) by blowing hot air at the temperature shown in Table 1 for 900 seconds. The resulting conjugate fibers were cut into staple fibers with a length of 51 mm. The staple fiber was analyzed for the orientation index and melting point of each constituent resin and heat extensibility in accordance with the methods described above. The results obtained are shown in Table 1. While not shown in the table, all the fibers had a fineness of 3.3 dtex.

The Q values in Table 1 were measured as follows.

I. Instrumentation (1) Cross-fractionation chromatograph: CFC T-100 from Dia Instruments Co., Ltd. (hereinafter "CFC")

(2) Fourier transform infrared absorption spectrometer: 1760× from Perkin Elmer, Inc. (hereinafter "FT-IR")

The fixed wavelength infrared spectrophotometer that was installed as a detector of CFC is taken off, and instead thereof, FT-IR is connected and used as the detector. The transfer line from the outlet of the eluate from CFC to FT-IR is 1 m and maintained at a temperature of 140° C. throughout the measurement. The flow cell attached to FT-IR has an optical path length of 1 mm and an optical path diameter of 5 mm and is maintained at a temperature of 140° C. throughout the measurement.

(3) Gel permeation chromatography (GPC):

Three GPC columns AD806MS from Showa Denko K.K. connected in series are used in the latter part of CFC.

II. Measuring Conditions of CFC:

(1) Solvent: Orthodichlorobenzene (ODCB)

(2) Sample concentration: 1 mg/ml (3) Injection volume: 0.4 ml (4) Column temperature: 140° C.

(5) Solvent flow rate: 1 ml/min

III. Measuring Conditions of FT-IR

After elution of the sample solution from GPC, the latter half of the CFC, starts, the FT-IR measurement is carried out under the following conditions, and GPC-IR data are collected.

(1) Detector: MCT (2) Resolution: 8 $cm^{-1}$ (3) Measurement interval: 0.2 minutes (=12 seconds)

(4) Number of scans per measurement: 15

IV. Post-Processing and Analysis of Measurement Results

The molecular weight distribution is determined using the absorbance at 2945 $cm^{-1}$ obtained by FT-IR as a chromatogram. The retention volume is converted to the molecular weight using a calibration curve previously prepared with standard polystyrenes as follows. Standard polystyrenes used are F380, F288, F128, F80, F40, F20, F10, F4, F1, A5000, A2500, and A1000, all available from Tosoh Corporation. Point four milliliters of a solution prepared by dissolving 0.5 mg/ml of each standard polystyrene in ODCB (containing 0.5 mg/ml of BHT) is injected to prepare a calibration curve. The calibration curve employs a cubic expression obtained by approximation by the least squares method. The conversion to the molecular weight employs a universal calibration curve by referring to Sadao Mori, Size Exclusion Chromatography (Kyoritsu Shuppan). For the viscosity expression used herein ($[\eta]=K\times M\alpha$), the following numerical values are used.

(1) In the preparation of calibration curve using standard polystyrenes $K=0.000138$, $\alpha=0.70$ (2) In the measurement of polypropylene samples $K=0.000103$, $\alpha=0.78$ While the molecular weight is measured by GPC (gel permeation chromatography) as described, the molecular weight measurement may also be carried out using other models. In such a case, the molecular weight measurement is conducted simultaneously with MG03B available from Japan Polypropylene Corp., which is described in 2005 *Plastic Seikei Zairyo Syotorihiki Binran*, The Chemical Daily Co., Ltd. (Aug. 30, 2004), and the value at which MG03B displays 3.5 is taken as a blank condition, and the conditions are adjusted to measure the molecular weight.

TABLE 1

| | | Example | | | | | | | |
|---|---|---|---|---|---|---|---|---|---|
| | | 1 | 2 | 3 | 4 | 5 | 6 | 7 | 8 |
| 1st Resin | Kind | PP | PP | PP | PP | PP | PP | PP | PP |
| | MFR | 12 | 23 | 30 | 30 | 30 | 30 | 30 | 30 |
| Component(I) (core) | Q Value | 3.5 | 3.5 | 3.5 | 3.5 | 3.5 | 3.5 | 3.5 | 3.5 |
| | Kind | HDPE | HDPE | HDPE | HDPE | HDPE | HDPE | HDPE | HDPE |
| 2nd Resin Component | MFR | 20 | 20 | 20 | 12 | 8 | 20 | 20 | 20 |
| (II) (sheath) | Q Value | 5.6 | 5.6 | 5.6 | 5.6 | 5.6 | 5.6 | 5.6 | 5.6 |
| Spinning Temp. (° C.) | | 270 | 270 | 270 | 270 | 270 | 250 | 270 | 270 |
| Take-up Speed (m/min) | | 1300 | 1300 | 1300 | 1300 | 1300 | 1300 | 1300 | 1300 |
| Tow Heating Temp. (° C.) | | 100 | 100 | 100 | 100 | 100 | 100 | 100 | 100 |
| Crimping Treatment | | yes | yes | yes | yes | yes | yes | yes | yes |
| Heat Treating Temp. (° C.) | | 110 | 110 | 110 | 110 | 110 | 110 | 65 | 65 |
| Conjugating Ratio I/II (core/sheath) | | 50/50 | 50/50 | 50/50 | 50/50 | 50/50 | 50/50 | 50/50 | 70/30 |
| Cross-sectional Configuration*/ Eccentricity (%) | | CON | CON | CON | CON | CON | CON | CON | CON |
| Orientation Index | I (core) (%) | 51 | 52 | 48 | 35 | 38 | 42 | 42 | 35 |
| | II (sheath) (%) | 49 | 48 | 50 | 49 | 57 | 42 | 47 | 51 |
| Melting Point | I (core) (° C.) | 164 | 165 | 165 | 164 | 164 | 164 | 164 | 163 |
| | II (sheath) (%) | 127 | 127 | 127 | 127 | 128 | 128 | 127 | 128 |
| Extensibility | at melting point of II (A) (%) | 8.1 | 8.9 | 8.2 | 6.3 | 5.3 | 7.3 | 4.7 | 12.0 |

TABLE 1-continued

| | | | | | | | | |
|---|---|---|---|---|---|---|---|---|
| at melting point of II + 10° C. (B) (%) | 13.2 | 12.5 | 13.7 | 11.7 | 11.6 | 14.2 | 9.1 | 15.1 |
| B − A (%) | 5.1 | 3.6 | 5.5 | 5.4 | 6.3 | 6.9 | 4.4 | 3.1 |

| | | Example | | Compara. Example | | | |
|---|---|---|---|---|---|---|---|
| | | 9 | 10 | 1 | 2 | 3 | 4 (2 fold drawn) |
| 1st Resin | Kind | PP | PP | PP | PP | PP | PP |
| | MFR | 30 | 30 | 23 | 8 | 30 | — |
| Component(I) (core) | Q Value | 2.8 | 3.5 | 7.0 | 3.0 | 2.3 | — |
| | Kind | HDPE | HDPE | HDPE | HDPE | HDPE | HDPE |
| 2nd Resin Component | MFR | 20 | 20 | 20 | 20 | 20 | — |
| (II) (sheath) | Q Value | 5.6 | 5.6 | 5.6 | 5.6 | 5.6 | — |
| Spinning Temp. (° C.) | | 270 | 270 | 270 | 270 | 270 | 250 |
| Take-up Speed (m/min) | | 1300 | 1300 | 1300 | 1300 | 1300 | 760 |
| Tow Heating Temp. (° C.) | | 100 | 100 | no | no | no | no |
| Crimping Treatment | | yes | yes | yes | yes | yes | yes |
| Heat Treating Temp. (° C.) | | 120 | 65 | 110 | 110 | 110 | — |
| Conjugating Ratio I/II (core/sheath) | | 80/20 | 70/30 | 50/50 | 50/50 | 50/50 | 50/50 |
| Cross-sectional Configuration*/ Eccentricity (%) | | ECC/25 | ECC/30 | CON | CON | CON | CON |
| Orientation Index | I (core) (%) | 65 | 61 | 63 | 66 | 18 | 95 |
| | II (sheath) (%) | 55 | 56 | 26 | 38 | 38 | 64 |
| Melting Point | I (core) (° C.) | 163 | 165 | 165 | 165 | 146 | 168 |
| | II (sheath) (%) | 128 | 128 | 127 | 127 | 128 | 132 |
| Extensibility | at melting point of II (A) (%) | 6.9 | 6.5 | 3.8 | 4.9 | 6.3 | −4.9 |
| | at melting point of II + 10° C. (B) (%) | 10.6 | 10.8 | 4.7 | 6.4 | 7.2 | −5.0 |
| | B − A (%) | 3.7 | 4.3 | 0.9 | 1.5 | 0.9 | −0.1 |

*CON stands for concentric; ECC stands for eccentric.

The heat extensible fibers of Examples 1 to 10 exhibited good heat extensibility because the constituent resins have controlled orientation indices as specified. These fibers also exhibited good cardability owing to the tow heating treatment given to the undrawn tow. In particular, the heat extensible fibers of Examples 8 to 10 in which the core component is greater in weight than the sheath component, especially those of Examples 9 and 10 having an eccentric cross-sectional configuration, developed a crimp configuration including both saw-tooth crimps resulting from mechanical crimping and wavy crimps as shown in FIG. 5(*d*) and therefore exhibited further improved cardability.

Figure 3:
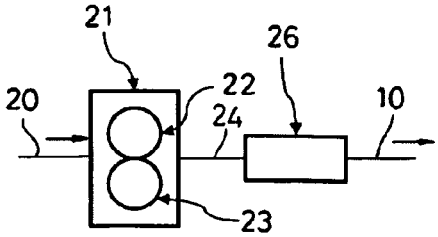
FIG. 3 schematically illustrates the process of producing the nonwoven fabric of FIG. 2.

Nonwoven fabric was prepared using each of the fibers obtained in Examples 1 and 6 and Comparative Example 4 by the method shown in FIGS. 3 and 4. Concrete conditions for the making of nonwoven fabric were as follows. The embossing was carried out to form circular bonded parts having a total area ratio of 3%. The processing temperature was 130° C. The through-air bonding was effected by blowing hot air at 136° C. from the side that had faced the smooth roll. The thickness, basis weight, and specific volume of the resulting nonwoven fabric were measured in accordance with the methods below. The three-dimensionality of the surface texture of the nonwoven fabric was evaluated as follows. The results are shown in Table 2.

(1) Measurement of Thickness, Basis Weight, and Specific Volume

A 12 cm-side square plate was mounted on a measuring stage. The vertical position of the upper surface of the plate was taken as a base point A. The plate was once removed, a test piece of the nonwoven fabric was placed on the measuring stage, and the plate was put thereon. The vertical position of the upper surface of the plate was taken as point B. The difference between points A and B was taken as the thickness of the test piece. The weight of the plate is subject to alteration depending on the purpose of the measurement. Here, a plate weighing 54 g was used. Measurements were made with a laser displacement meter (CCD laser displacement sensor LK-080, from Keyence Corp.). A dial gauge type thickness meter will do in place of the displacement meter, in which case, however, the load applied to the test piece should be adjusted. Considering that the thickness of nonwoven fabric largely depends on the basis weight, a specific volume ($cm^3$/g) calculated from thickness and basis weight was adopted as a measure of bulkiness. While the basis weight can be measured by any method, it is conveniently obtained by weighing the test piece used in the thickness measurement and dividing the area of the test piece by the weight.

(2) Evaluation of Three-Dimensionality

The nonwoven fabric was observed with the naked eye, and the three-dimensionality of the surface texture was rated as follows.

A: The surface has a clearly definite three-dimensional texture.

B: The surface has a three-dimensional texture.

C: The surface is hardly regarded to be three-dimensionally textured.

D: The surface is not three-dimensionally textured.

TABLE 2

| Constituent Fiber | Example 1 | Example 6 | Compara. Example 4 (2-fold drawn) |
|---|---|---|---|
| Basis Weight (g/$m^2$) | 24.9 | 24.4 | 26.5 |
| Thickness (mm) | 1.97 | 2.34 | 2.00 |
| Specific Volume ($cm^3$/g) | 79.3 | 95.9 | 75.4 |
| Three-dimensionality | A | A | D |

The results in Table 2 clearly prove that the nonwoven fabrics prepared from the fibers of Examples are bulky and have a three-dimensional texture.

Industrial Applicability

As described in detail, the heat extensible fiber of the present invention has higher heat extensibility than conventional extensible fibers. Therefore, nonwoven fabric produced by heat-treating the heat extensible fibers of the invention has high bulkiness or a three-dimensional texture as a result of the extension of the fibers. Since the heat extensible fiber of the invention has per se heat fusibility, it is capable alone of producing thermal-bonded nonwoven fabric easily.

The invention claimed is:

1. A heat extensible fiber comprising a conjugate fiber including a first resin component having an orientation index of 30% to 70% and a second resin component having a lower melting point or softening point than the melting point of the first resin component and an orientation index of 40% to 70%, the second resin component being present on at least part of the surface of the conjugate fiber in a lengthwise continuous configuration, the conjugate fiber being a heat-treated or crimped fiber and being configured to thermally extend when heated at a temperature lower than the melting point of the first resin component, and the heat extensible conjugate fiber having a heat extensibility of 3% to 20% at a temperature 10° C. higher than the melting or softening point of the second resin component;

wherein the heat extensible fiber is prepared without drawing.

2. The heat extensible fiber according to claim 1, wherein the difference between the melting point of the first resin component and the melting point or softening point of the second resin component is 20° C. or more.

3. The heat extensible fiber according to claim 1, wherein the heat extensibility of the heat extensible fiber at a temperature 10° C. higher than the melting point of the second resin component is higher than that at the melting point of the second resin component by at least 3 points.

4. The heat extensible fiber according to claim 1, wherein the first resin component is polypropylene, and the second resin component is polyethylene.

5. Nonwoven fabric comprising the heat extensible fibers according to claim 1 in a state having thermally extended by heat application.

6. The nonwoven fabric according to claim 5, wherein a number of bonded parts where the fibers are partially press-bonded or adhesively bonded to each other is formed, and the fibers between the bonded parts are thermally extended by heat application.

7. The nonwoven fabric according to claim 5, wherein the heat extensible fibers are in a state having thermally extended such that the nonwoven fabric has a bulky and/or three-dimensional appearance.

8. A process of producing the heat extensible fiber according to claim 1, comprising the steps of:

melt spinning polypropylene having a melt flow rate of 10 to 35 g/10 min and a Q value of 2.5 to 4.0 and polyethylene at a take-up speed less than 2000 m/min to obtain a conjugate fiber and, subjecting the conjugate fiber to a heat treatment or a crimping treatment, with the proviso that no drawing is carried out.

9. The process of producing the heat extensible fiber according to claim 8, wherein the polyethylene has a melt flow rate of 8 to 30 g/10 min and a Q value of 4.0 to 7.0.

10. The heat extensible fiber according to claim 4, wherein the polypropylene has a melt flow rate of 10 to 35 g/10 min and a Q value of 2.5 to 4.0, and polyethylene has a melt flow rate of 8 to 30g/10 min and a Q value of 4.0 to 7.0.

11. The heat extensible fiber according to claim 1, wherein the heat extensible conjugate fiber has a heat extensibility of 7.5% to 20% at a temperature 10° C. higher than the melting or softening point of the second resin component.

* * * * *